US008152159B2

(12) United States Patent
Okumura

(10) Patent No.: US 8,152,159 B2
(45) **Date of Patent: *Apr. 10, 2012**

(54) SHEET FEEDING DEVICE AND IMAGE FORMING APPARATUS INCLUDING A CONTROLLED ELEVATOR MECHANISM

(75) Inventor: Keiji Okumura, Osaka (JP)

(73) Assignee: Kyocera Mita Corporation (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/551,726

(22) Filed: Sep. 1, 2009

(65) Prior Publication Data

US 2010/0059929 A1 Mar. 11, 2010

(30) Foreign Application Priority Data

Sep. 8, 2008 (JP) ..... 2008-230001

(51) Int. Cl.
*B65H 1/08* (2006.01)

(52) U.S. Cl. ... 271/127; 271/118; 271/153; 271/258.03; 271/259; 271/265.02

(58) Field of Classification Search ..... None
See application file for complete search history.

(56) References Cited

U.S. PATENT DOCUMENTS

| | | | | |
|---|---|---|---|---|
| 4,294,540 | A * | 10/1981 | Thettu | 271/197 |
| 4,925,177 | A * | 5/1990 | Nakamura et al. | 271/127 |
| 5,354,047 | A * | 10/1994 | Chesnutt et al. | 271/197 |
| 5,445,369 | A * | 8/1995 | Golicz et al. | 271/197 |
| 5,470,052 | A * | 11/1995 | Asakawa et al. | 271/118 |
| 2005/0206068 | A1* | 9/2005 | Sasaki et al. | 271/98 |
| 2007/0080491 | A1* | 4/2007 | Suga et al. | 271/97 |
| 2008/0088077 | A1* | 4/2008 | Fujita | 271/90 |
| 2009/0236794 | A1* | 9/2009 | Tsukamoto et al. | 271/11 |
| 2010/0001454 | A1* | 1/2010 | Okumura et al. | 271/97 |
| 2010/0025919 | A1* | 2/2010 | Okumura et al. | 271/162 |
| 2010/0032890 | A1* | 2/2010 | Okumura et al. | 271/162 |

FOREIGN PATENT DOCUMENTS

| | | |
|---|---|---|
| JP | 8-59012 | 3/1996 |
| JP | 11-208906 | 8/1999 |
| JP | 11-343037 | 12/1999 |
| JP | 2003-221138 | 8/2003 |
| JP | 2004-284818 | 10/2004 |

* cited by examiner

*Primary Examiner* — Gerald McClain
(74) *Attorney, Agent, or Firm* — Gerald E. Hespos; Michael J. Porco

(57) ABSTRACT

A sheet feeding device has: a sheet accommodating portion that accommodates a sheet stack of a plurality of sheets; a sheet carrying plate that is provided within the sheet accommodating portion and stacks the sheet stack thereon; a pickup roller that contacts an upper face of the sheet stack and dispatches a sheet on an uppermost layer of the sheet stack, an elevator mechanism that displaces the sheet carrying plate between a sheet feeding position in which the upper face of the sheet stack contacts the pickup roller, and a separating position in which the upper face of the sheet stack separates from the pickup roller by a predetermined distance; and a controller that controls an operation of the elevator mechanism such that the sheet carrying plate is lowered to the separating position after a sheet feeding operation for feeding a sheet at the sheet feeding position is completed.

14 Claims, 11 Drawing Sheets

SHEET FEEDING DEVICE AND IMAGE FORMING APPARATUS INCLUDING A CONTROLLED ELEVATOR MECHANISM

This application claims priority under 35 USC 119 to Japanese Patent Application No. 2008-23001 filed on Sep. 8, 2008, the entire disclosure of which is incorporated herein by reference.

BACKGROUND OF THE INVENTION

1. Field of the Invention

The present invention relates to a sheet feeding device that is used in an image forming apparatus such as a printer, a copier, a facsimile, or a complex machine having a combination of these functions, as well as to an image forming apparatus having the sheet feeding device.

2. Description of the Related Art

In a conventional image forming apparatus such as a printer, a copier, or a facsimile, cut sheets of high quality paper, regular paper specified by a copier manufacturer, and so on are typically used as a sheet that can be fed continuously into the image formation apparatus.

In recent years, however, diversification of sheets has progressed to the point where not only sheets of high quality paper, regular paper, and so on having low surface smoothness are used. In particular, as colorization techniques become more advanced in image forming apparatuses, the use of enhanced-whiteness gloss coated paper having high surface smoothness (composite paper coated on one or both sides with a coating color, which is a type of paint, with the aim of improving printing suitability) is becoming more widespread. In other words, in recent years, there is a high demand for carrying not only high quality paper and regular paper, but also the coated paper described above, as well as film sheets, tracing paper, and so on using the same machine type. The volumes of coated paper, film sheets, tracing paper, and the like easily expand especially when they absorb moisture under a high-humidity environment. Hence, special measures must be taken in relation to sheet feeding (sheet dispatch).

Moreover, in recent years, with the demand for high speed sheet feeding, an image forming apparatus is used in which a pickup roller is constantly in contact with sheets even after completion of feeding the first sheet and when feeding of the next sheet is started.

However, when the pickup roller remains in contact with the sheets, the components contained in the pickup roller adhere to the sheets, causing a problem in which the surfaces of the sheets get contaminated. Further, when a sheet having high surface smoothness, such as gloss art paper or coat paper is used, adhesion of the components contained in the pickup roller damages the smoothness of the surface of the sheet. Moreover, a sheet with high surface smoothness easily swells when absorbing moisture, causing a problem in which wrinkles are easily generated on the sheet.

SUMMARY OF THE INVENTION

An object of the present invention is to provide a sheet feeding device capable of high-speed continuous sheet feeding to feed sheets having high surface smoothness without causing the occurrence of stains, wrinkles and so on, and to provide an image forming apparatus having this sheet feeding device.

A sheet feeding device according to one aspect of the present invention for achieving this object is a sheet feeding device, including: a sheet accommodating portion that accommodates a sheet stack constituted by a plurality of sheets; a sheet carrying plate that is provided within the sheet accommodating portion and stacks the sheet stack thereon; a pickup roller that contacts an upper face of the sheet stack and dispatches a sheet on an uppermost layer of the sheet stack; an elevator mechanism that displaces the sheet carrying plate between a sheet feeding position in which the upper face of the sheet stack contacts the pickup roller, and a separating position in which the upper face of the sheet stack separates from the pickup roller by a predetermined distance; and a controller that controls an operation of the elevator mechanism such that the sheet carrying plate is lowered to the separating position after a sheet feeding operation for feeding a sheet located in the sheet feeding position is completed.

An image forming apparatus according to another aspect of the present invention includes a sheet feeding device for feeding a sheet, and an image forming portion for forming an image onto the sheet fed from the sheet feeding device, wherein the sheet feeding device is configured as described above.

DETAILED DESCRIPTION OF THE PREFERRED EMBODIMENTS

The best embodiments of the present invention are described hereinafter in detail with reference to the drawings.

<First Embodiment>

Figure 1:
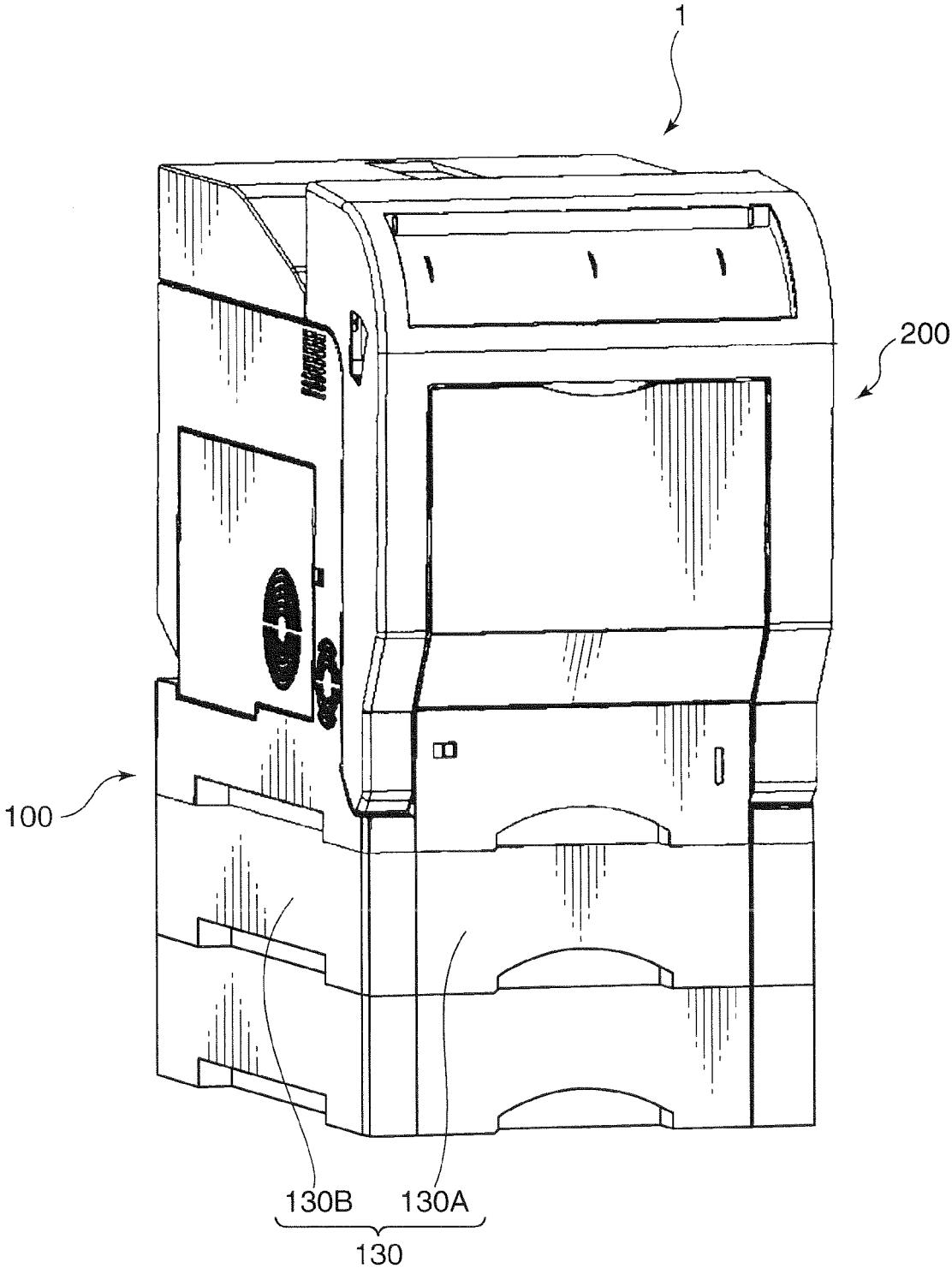
FIG. 1 is a perspective view showing the outer form of a printer including a sheet feeding device according to an embodiment of the present invention.
Figure 2:
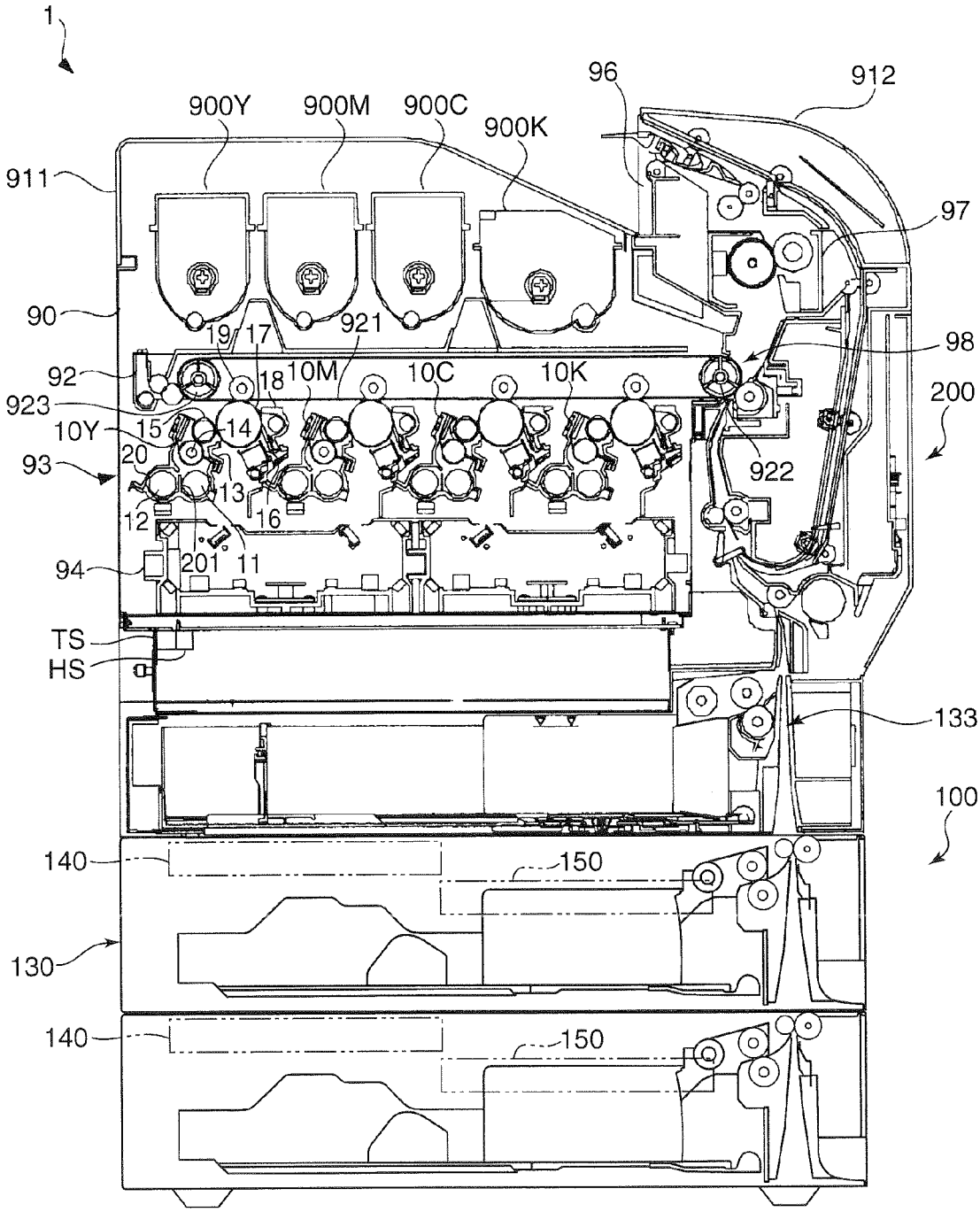
FIG. 2 is a cross-sectional view showing the internal constitution of the printer.

An image forming apparatus having a sheet feeding device according to an embodiment of the present invention is described with reference to FIGS. 1 and 2. FIG. 1 is a perspective view showing the outer form of a color printer 1 (image forming apparatus) having a sheet feeding device of a first embodiment of the present invention. FIG. 2 is a cross-sectional view showing the internal configuration of the color printer 1.

The color printer 1 includes a printer main body 200 connected to a personal computer (PC) (not shown) or the like directly or via a LAN, and a sheet supply unit 100 provided beneath the printer main body 200 and constituted to be capable of storing sheets P of various sizes in accordance with their size. Note that the color printer 1 also includes other constitutional elements typically provided in a color printer, such as a control circuit for controlling operations of the color printer 1.

The printer main body 200 includes toner containers 900Y, 900M, 900C, 900K, an intermediate transfer unit 92, an image forming unit 93, an exposure unit 94, the sheet supply unit 100, a fixing unit 97, a sheet discharge unit 96, an apparatus main body casing 90, a top cover 911, and a front cover 912.

The image forming unit 93 includes a yellow toner container 900Y, a magenta toner container 900M, a cyan toner container 900C, a black toner container 900K, and developing devices 10Y, 10M, 10C, 10K disposed therebelow in accordance with the respective colors YMCK.

Further, photosensitive drums 17 (photosensitive bodies on which latent images are formed by an electrophotographic method) for carrying toner images in the respective colors are provided in the image forming unit 93. A photosensitive drum using an amorphous silicon (a-Si)-based material may be employed as this photosensitive drum 17. Yellow, magenta, cyan, and black toner is supplied to the respective photosensitive drums 17 from the corresponding toner container 900Y, 900M, 900C, 900K. The image forming unit 93 described above is capable of forming a full color image, but the image formation unit is not limited thereto, and may be constituted to form monochrome images or color images that are not full color.

A charger 16, the developing devices 10 (10Y, 10M, 10C, 10K), a transfer device (transfer roller) 19, a cleaning device 18, and so on are disposed around the photosensitive drum 17. The charger 16 charges the surface of the photosensitive drum 17 uniformly. After being charged, the surface of the photosensitive drum 17 is exposed by the exposure unit 94 such that an electrostatic latent image is formed thereon. The developing devices 10Y, 10M, 10C, 10K use the colored toner supplied by the respective toner containers 900Y, 900M, 900C, 900K to develop (make visible) the electrostatic latent images formed on the respective photosensitive drums 17. The transfer roller 19 forms a nip portion by pressing the intermediate transfer belt 921 against the photosensitive drum 17 and thereby subjects the toner image formed on the photosensitive drum 17 to primary transfer onto the intermediate transfer belt 921. The cleaning device 18 cleans the peripheral surface of the photosensitive drum 17 following toner image transfer.

Each developing devices 10Y, 10M, 10C, 10K includes the casing 20, and a two-component developer constituted by a magnetic carrier and a toner is stored in the interior of the casing 20. Further, two agitating rollers 11, 12 (developer agitating members) are disposed rotatably in the vicinity of a bottom portion of the casing 20 in parallel, taking a lengthwise direction as their axial direction.

A developer circulation route is set on the interior bottom surface of the casing 20, and the agitating rollers 11, 12 are disposed on the circulation route. A partition wall 201 standing upright from the casing bottom portion is provided in the axial direction between the agitating rollers 11, 12. The partition wall 201 defines the circulation route, and the circulation route is formed to travel around the periphery of the partition wall 201. The two-component developer is charged while being agitated by the agitating rollers 11 and 12 so as to travel along the circulation route.

The two-component developer circulates through the casing 20 while being agitated by the agitating rollers 11 and 12, whereby the toner is charged and the two-component developer on the agitating roller 11 is aspirated onto and conveyed by a magnetic roller 14 positioned on an upper side thereof. The aspirated two-component developer forms a magnetic brush (not shown) on the magnetic roller 14, and a layer thickness of this magnetic brush is regulated by a doctor blade 13. A toner layer is formed on a developing roller 15 by a potential difference between the magnetic roller 14 and the developing roller 15. Then, the electrostatic latent image on the photosensitive drum 17 is developed by the toner layer formed on the developing roller 15.

The exposure unit 94 includes various optical devices such as a light source, a polygon mirror, a reflection mirror, and a deflection mirror, and irradiates the peripheral surface of the photosensitive drum 17 provided in each of the image forming units 93 with light based on image data to form the electrostatic latent image.

The intermediate transfer unit 92 includes the intermediate transfer belt 921, a drive roller 922, and a driven roller 923. The intermediate transfer belt 921 performs a primary transfer on superimposed toner images applied thereto from the plurality of photosensitive drums 17, and then subjects the toner image to a secondary transfer onto a sheet P supplied by the sheet feeding unit 130 at a secondary transfer portion 98. The drive roller 922 and driven roller 923 drive the intermediate transfer belt 921 to revolve. The drive roller 922 and driven roller 923 are supported by a casing, not shown in the drawings, to be free to rotate.

A sheet feeding unit 130 accommodates a sheet stack S constituted by a plurality of sheets P to be subjected to image formation, and is attached detachably to the casing 90.

The fixing unit 97 implements fixing processing on the toner image subjected to the secondary transfer onto the sheet P from the intermediate transfer unit 92. Following completion of the fixing processing, the sheet P including a color image is discharged toward the discharge unit 96 formed on an upper portion of the apparatus main body 200.

The sheet discharge unit 96 discharges the sheet P conveyed thereto from the fixing unit 97 onto the top cover 911, which serves as a sheet discharge tray.

The sheet supply unit 100 includes a plurality of (three in this embodiment) sheet feeding units (sheet feeding devices) 130 attached detachably to the printer main body 200 in tiers. Each sheet feeding unit 130 accommodates a sheet stack S constituted by a plurality of sheets P to be subjected to image formation, and is attached detachably to the casing 90. Sheet stacks S in each of the aforementioned sizes are stored in the respective sheet feeding units 130. In a selected sheet feeding unit 130 during an image formation operation, sheets P on the uppermost layer of the sheet stack S are extracted one at a time by driving a pickup roller 40 provided in the sheet feeding unit 130, dispatched onto a sheet feeding conveyance path 133, and introduced into the image forming unit 93.

Each sheet feeding unit 130 includes a conveyance mechanism, a plurality of which can be attached to a lower portion of the printer main body 200 subsequently in a stacked plurality, and thus, a desired number of the sheet feeding units 130 can be attached subsequently to the printer main body 200 at any time. In other words, by stacking a plurality of the sheet feeding units 130 in the lower portion of the printer main body 200, the conveyance mechanisms provided in the respective sheet feeding units 130 are coupled to each other to form the single sheet feeding conveyance path 133 extending to the printer main body 200. Hence, the sheet feeding units 130 can be attached subsequently in a plurality of stacked tiers.

Note that in this embodiment, an example in which the sheet supply unit 100 is constituted by three sheet feeding units 130 is described. However, not being limited to this, the example can be similarly applied to an image forming apparatus such as a printer having one, two, four, or more sheet feeding units 130.

Next, with reference to FIG. 1 and FIGS. 3 to 5B, the constitution of each sheet feeding unit 130 attached to the sheet supply unit 100 of the color printer 1 according to the present embodiment will be described in detail. As shown in FIG. 1, the sheet feeding unit 130 is constituted by a sheet feeding cassette 130A and a sheet feeding unit main body 130B. The sheet feeding cassette 130A slides forward and backward relative to the sheet feeding unit main body 130B. A typical sliding mechanism (a drawer mechanism) may be employed in the sheet feeding cassette 130A and the sheet feeding unit main body 130B.

Figure 3:
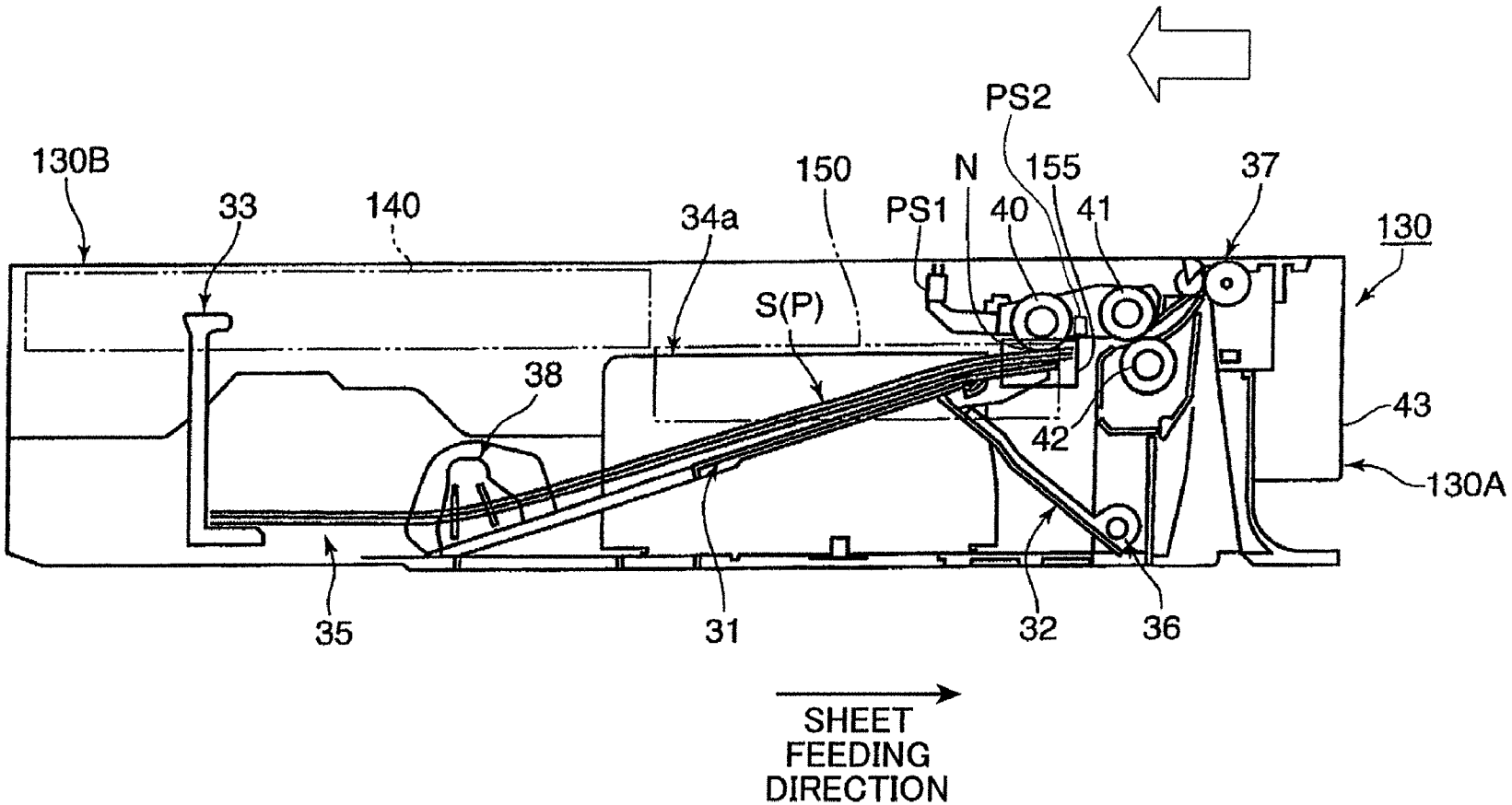
FIG. 3 is a cross-sectional view showing the configuration of the sheet feeding device.
Figure 4:
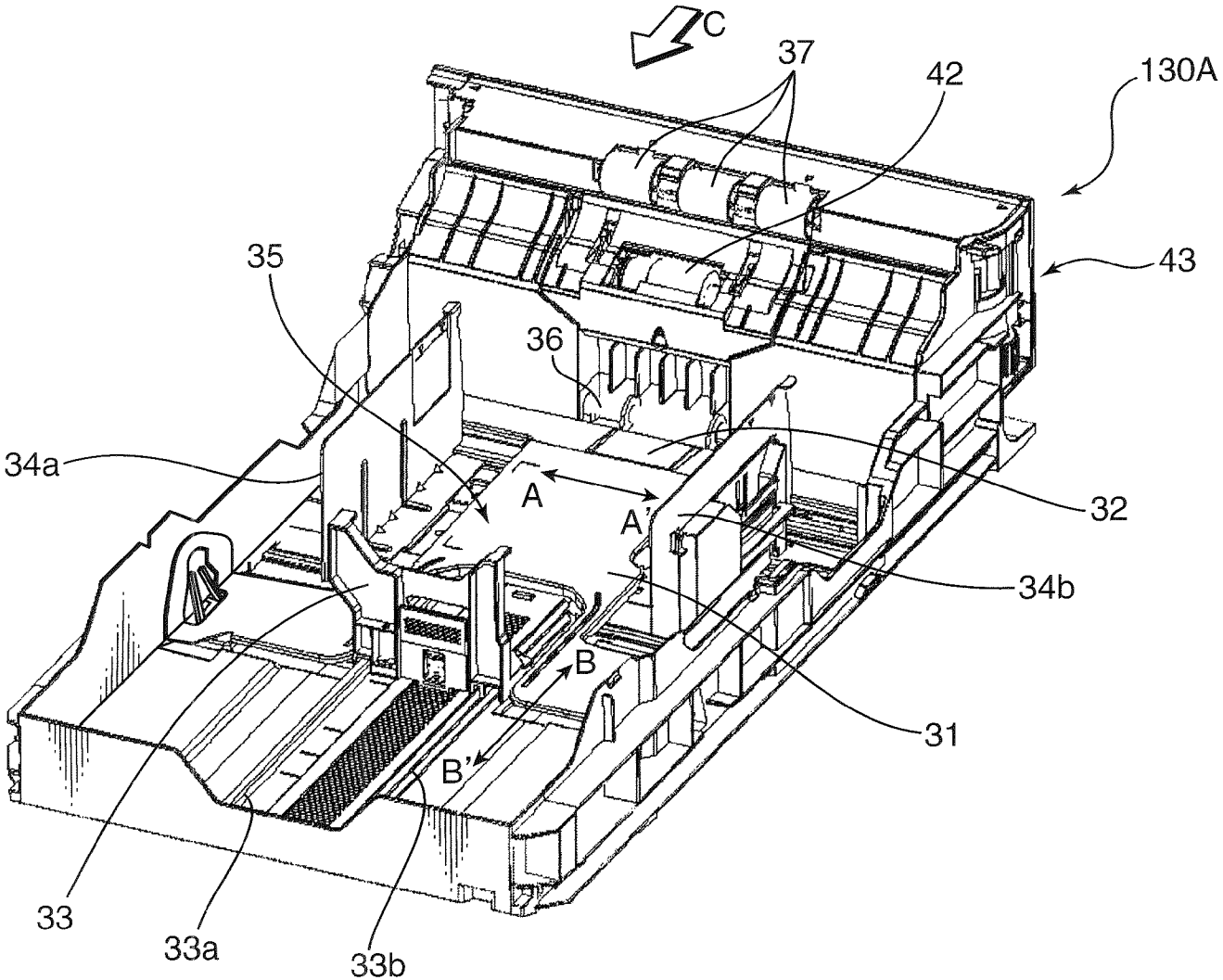
FIG. 4 is a perspective view showing a state in which a sheet feeding cassette of the sheet feeding device is withdrawn from a sheet feeding device main body.
Figure 5B:
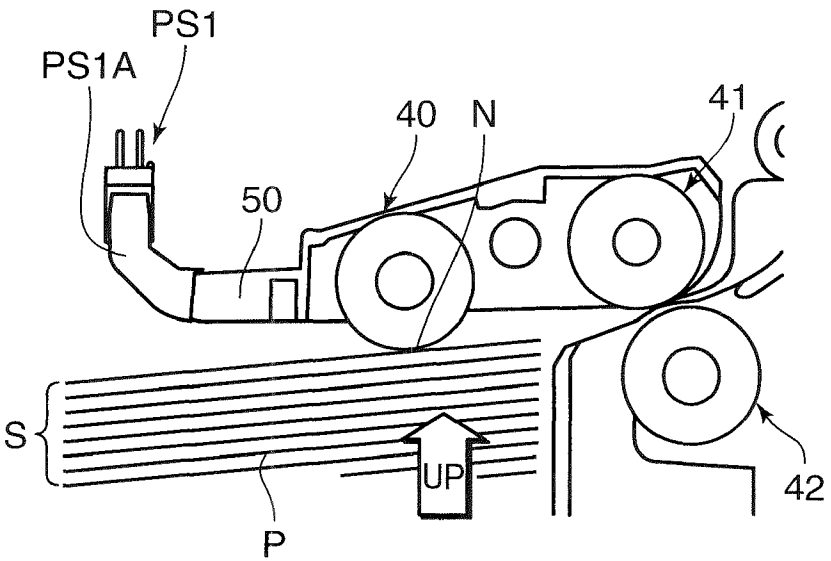
FIGS. 5A and 5B are illustrative views showing a position detection sensor installed in the sheet feeding device.
Figure 5A:
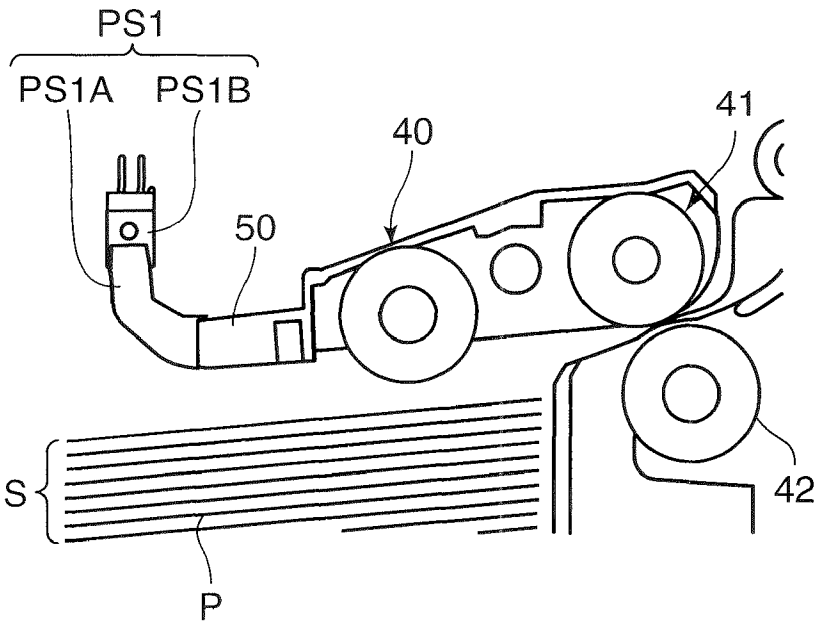

FIG. 3 is a cross-sectional view of the sheet feeding unit 130. FIG. 4 is a perspective view showing a state in which the sheet feeding cassette 130A of the sheet feeding unit 130 is withdrawn from the sheet feeding unit main body 130B. FIGS. 5A and 5B are an illustrative view showing a position detection sensor installed in the sheet feeding unit 130.

As shown in FIGS. 3 and 4, a lift plate (sheet carrying plate) 31 for carrying the sheet stack S constituted by a plurality of the sheets P is provided on an inner bottom surface of a sheet accommodating portion 35 of the sheet feeding unit 130. A sheet feeding direction upstream end (a left side end portion in FIG. 3) of the lift plate 31 is supported rotatably by a support portion 38. In other words, the lift plate 31 can be rotated by the support portion 38 in a vertical plane in the interior of the sheet accommodating portion 35 using a downstream end thereof as a free end. The support portion 38 is provided on wall portions on either side of the sheet accommodating portion 35, which is disposed to face a width direction of the sheet P (an orthogonal direction to the sheet feeding direction).

The sheet feeding cassette 130A of the sheet feeding unit 130 includes a pair of width alignment cursors 34*a*, 34*b* for positioning the sheets P accommodated in the sheet accommodating portion 35 in the width direction, and a rear end cursor 33 for aligning a rear end of the sheets P. The pair of width alignment cursors 34*a*, 34*b* are provided to be capable of performing a reciprocating motion in the sheet width direction (a direction indicated by an arrow AA' in FIG. 4) along respective guide rails, not shown in the drawings. Here, the sheet P is dispatched in a direction indicated by an arrow B, and therefore the rear end cursor 33 is provided to be capable of performing a reciprocating motion parallel to the sheet conveyance direction (a direction indicated by an arrow BB' in FIG. 4) along guide rails 33*a*, 33*b*. The sheet stack S is accommodated in a predetermined position of the sheet feeding unit 130 once the width alignment cursors 34*a*, 34*b* and the rear end cursor 33 have been moved in accordance with the size of the carried sheets. The sheet feeding unit 130 includes a cassette cover 43, a front surface side (a side seen from a direction indicated by an arrow C in FIG. 4) of which is exposed to the outside to form a part of an outer covering surface of the color printer 1.

Figure 9:
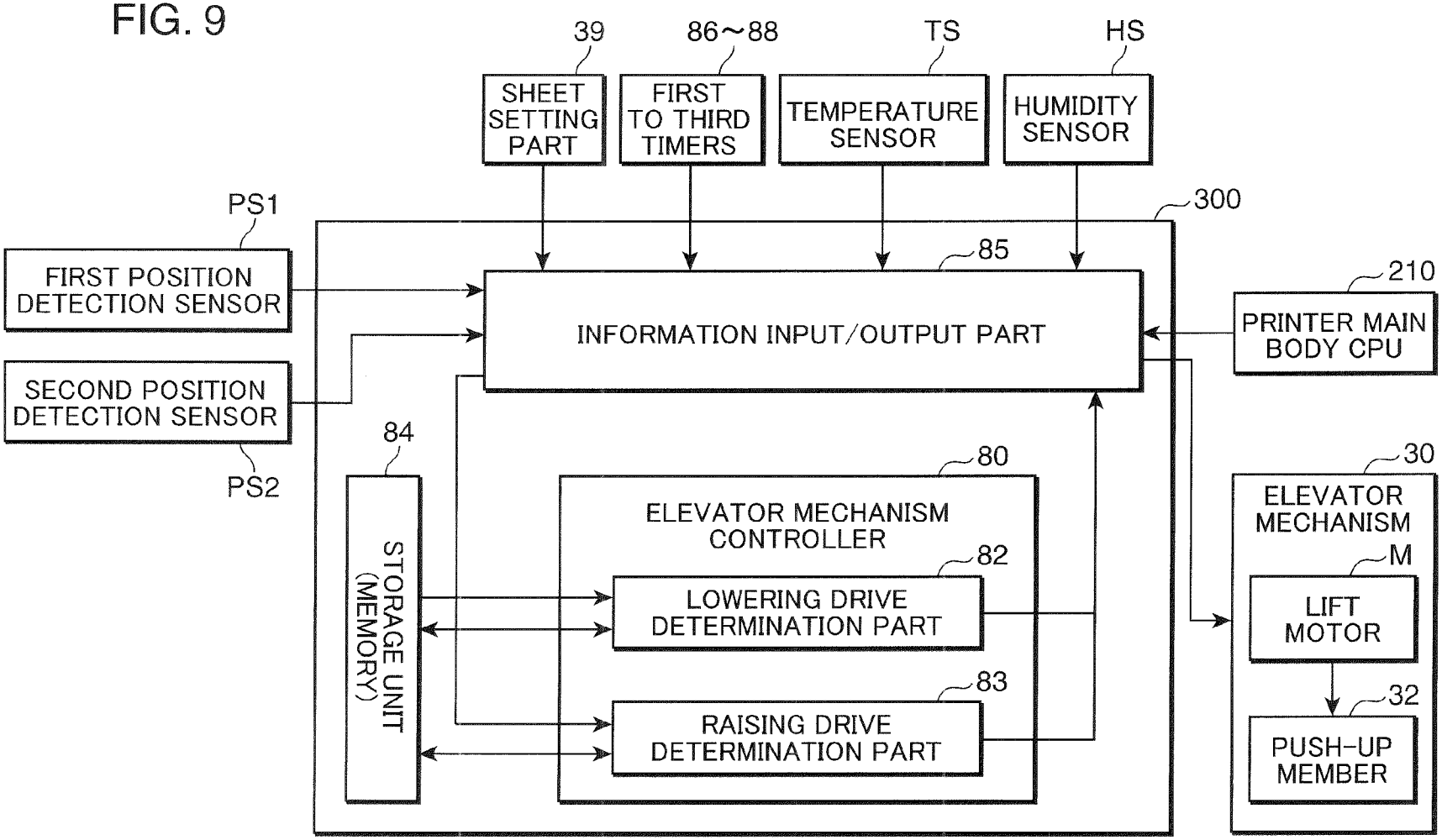
FIG. 9 is a functional block diagram of a controller.

A drive shaft 36, a push-up member 32, and a driving connecting member (not shown) are provided below a sheet feeding direction downstream side of the lift plate 31 as an elevator mechanism 30 for raising and lowering the lift plate 31 (FIG. 9). Further, a receiving member (not shown) corresponding to the driving connecting member and a lift motor M (shown in FIG. 9) that is connected to the receiving member and capable of normal and reverse rotation are provided on the sheet feeding unit main body 130B. When the sheet feeding cassette 130A is accommodated in the sheet feeding unit main body 130B, the driving connecting member of the sheet accommodating portion 35 on the sheet feeding cassette 130A side engages connectedly with the receiving member on the sheet feeding unit main body 130B side. Thus, the power of the lift motor M can be transmitted to the drive shaft 36. The elevator mechanism 30, which displaces the lift plate 31 between a sheet feeding position and a withdrawn position withdrawn from the sheet feeding position, is constituted by the drive shaft 36, the push-up member 32, the driving connecting member, the lift motor M.

In the sheet feeding position according to this embodiment, the lift plate 31 is raised such that an upper face of the sheet stack S placed on the lift plate 31 comes into contact with the pickup roller 40, enabling sheet feeding. In the separating position where the upper face of the sheet stack S is separated from the pickup roller 40, the lift plate 31 is lowered to a position that is provided with a minimum required space so that an upper face of a selected type of sheet P does not come into contact with the pickup roller 40.

The type of the sheet P to be fed can be selected by a sheet setting part 39. The sheet setting part 39 can be provided on an operation panel (not shown) of the sheet feeding unit 130 or the printer main body 200.

Note that a stepping motor, a DC motor or the like can be used as a lift motor M constituting the elevating mechanism 30 for raising and lowering the lift plate 31.

Further, as shown in FIG. 3, the sheet feeding unit 130 includes a sheet feeding roller 41 provided on a conveyance direction downstream side of the pickup roller 40, and a loosening roller 42 provided below the sheet feeding roller 41. Further, a conveyance roller 37 is provided on the conveyance direction downstream side of the pickup roller 40 and the sheet feeding roller 41. The sheet feeding roller 41 is provided on the sheet feeding unit main body 130B side together with the pickup roller 40, whereas the loosening roller 42 and the conveyance roller 37 are provided on the sheet feeding cassette 130A side. When the sheet feeding cassette 130A is attached to the sheet feeding unit main body 130B, the sheet feeding roller 41 contacts the loosening roller 42.

The sheet feeding roller 41 feeds a sheet P extracted by the pickup roller 40 to the conveyance roller 37. The sheet feeding roller 41 rotates in a direction for conveying the sheet P downstream, whereas the loosening roller 42 rotates in an opposite direction for returning the sheet P upstream. In a case where a plurality of overlapped sheets P is extracted by the pickup roller 40, the loosening roller 42 can be used to prevent all but the uppermost sheet P from being fed in the direction of the conveyance roller 37, and thus only the uppermost sheet P is conveyed to the conveyance roller 37 by the sheet feeding roller 41. Thus, the conveyance roller 37 conveys the sheet P onto the sheet feeding conveyance path 133 (see FIG. 2).

Further, as shown in FIGS. 5A and 5B, the sheet feeding unit 130 includes the first position detection sensor PS1 for detecting that the uppermost sheet P of the sheet stack S carried on the lift plate 31 is in the sheet feeding position. The first position detection sensor PS1 is constituted by a light blocking member PS1A and an optical sensor PS1B. The optical sensor PS1B is constituted by a light emitting element provided fixedly in the vicinity of the pickup roller 40, and a light receiving element for receiving light emitted by the light emitting element. The light blocking member PS1A is provided on a support member 50 of the pickup roller 40. Further, the support member 50 is provided to be capable of rotating about a rotary axis of the sheet feeding roller 41. Hence, when the lift plate 31 is raised such that the upper face of the sheet stack S carried on the lift plate 31 moves into the sheet feeding position shown in FIG. 5B, the pickup roller 40 is pushed up by the uppermost sheet P so as to rotate about the rotary axis of the sheet feeding roller 41 and thereby displace slightly upward. At this time, the light blocking member PS1A is lifted up in conjunction with the pickup roller 40, thereby blocking an optical path of the optical sensor PS1B, and accordingly, it is possible to detect that the upper face of the sheet stack S is in the sheet feeding position.

When the lift motor M is activated in the sheet feeding unit 130 constituted as described above, the push-up member 32 pushes up the downstream end side of the lift plate 31 while remaining engaged with the bottom surface of the lift plate 31. As a result, the upper face of the sheet stack S carried on the lift plate 31 displaces to the sheet feeding position contacting the pickup roller 40 provided above the sheet feeding cassette 130A.

At this time, driving of the lift motor M is stopped when the first position detection sensor PS1 detects that the pickup roller 40 is displaced to the sheet feeding position, as shown in FIG. 5B.

In this embodiment, as will be described hereinafter in detail, the elevator mechanism 30 (FIG. 9) is controlled to start the driving for lowering the lift plate 31 after completion of the sheet feeding operation, and to continue driving for lowering the lift plate 31 until a first predetermined time period elapses since the first position detection sensor PS1 stops detecting that the upper face of the sheet stack S is in the sheet feeding position.

The sheet feeding unit 130 according to this embodiment is provided with, in addition to the first position detection sensor PS1 described above, a second position detection sensor PS2 (FIG. 9) that detects that the upper face of the sheet stack S contacts the pickup roller 40. For example, a reflective sensor can be used as the second position detection sensor PS2. The second position detection sensor PS2, for example, is provided on the conveyance direction downstream side in the vicinity of a point N (FIG. 3) where the upper face of the sheet stack S contacts the pickup roller 40, and can detect a tip end of the sheet P contacting the pickup roller 40.

Note that in this embodiment the two position detection sensors of the first position detection sensor PS1 and the second position detection sensor PS2 are provided, but the present invention is not limited thereto and may be provided with only one of them.

Figure 6:
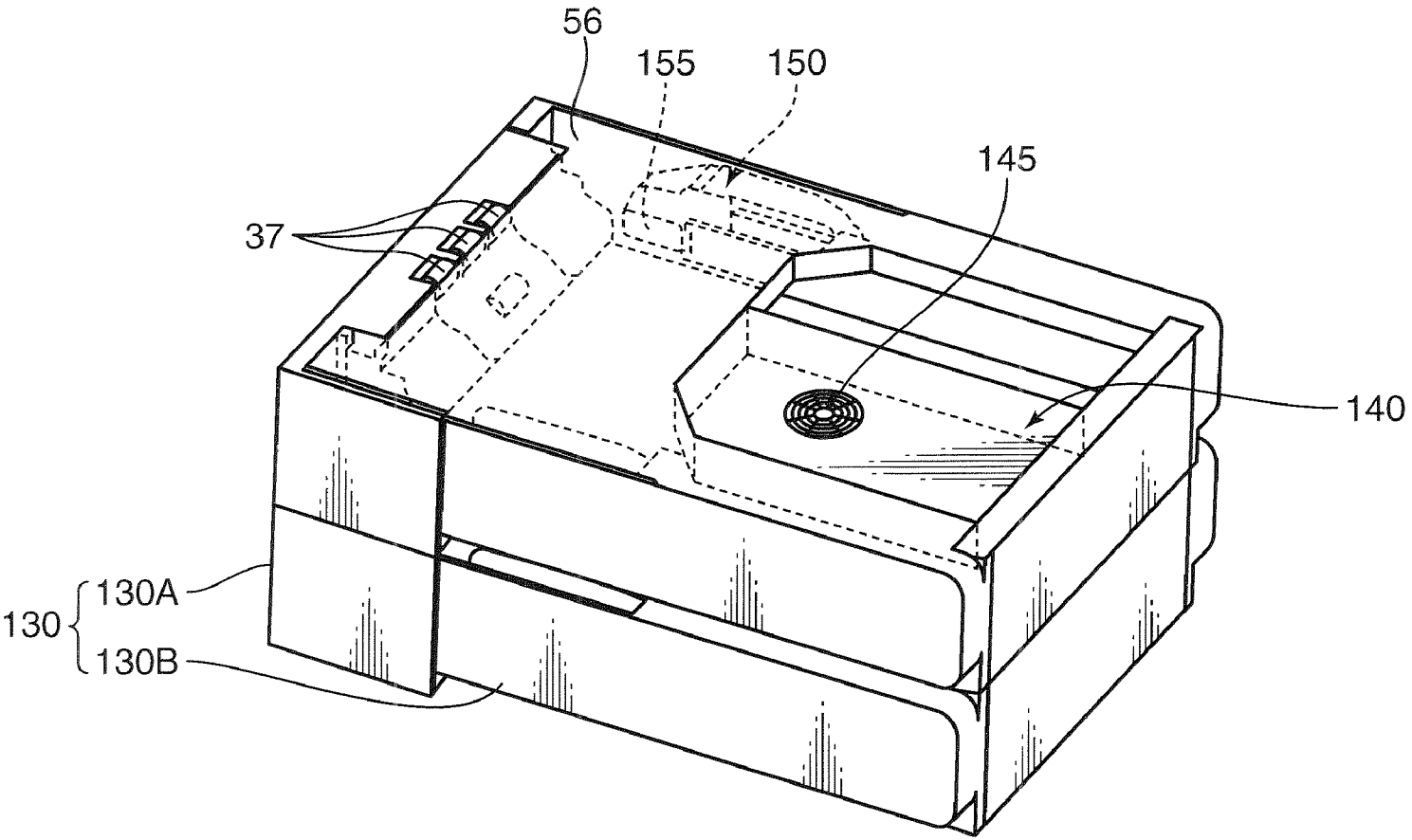
FIG. 6 is an illustrative view showing the configuration of the sheet feeding device.
Figure 7:
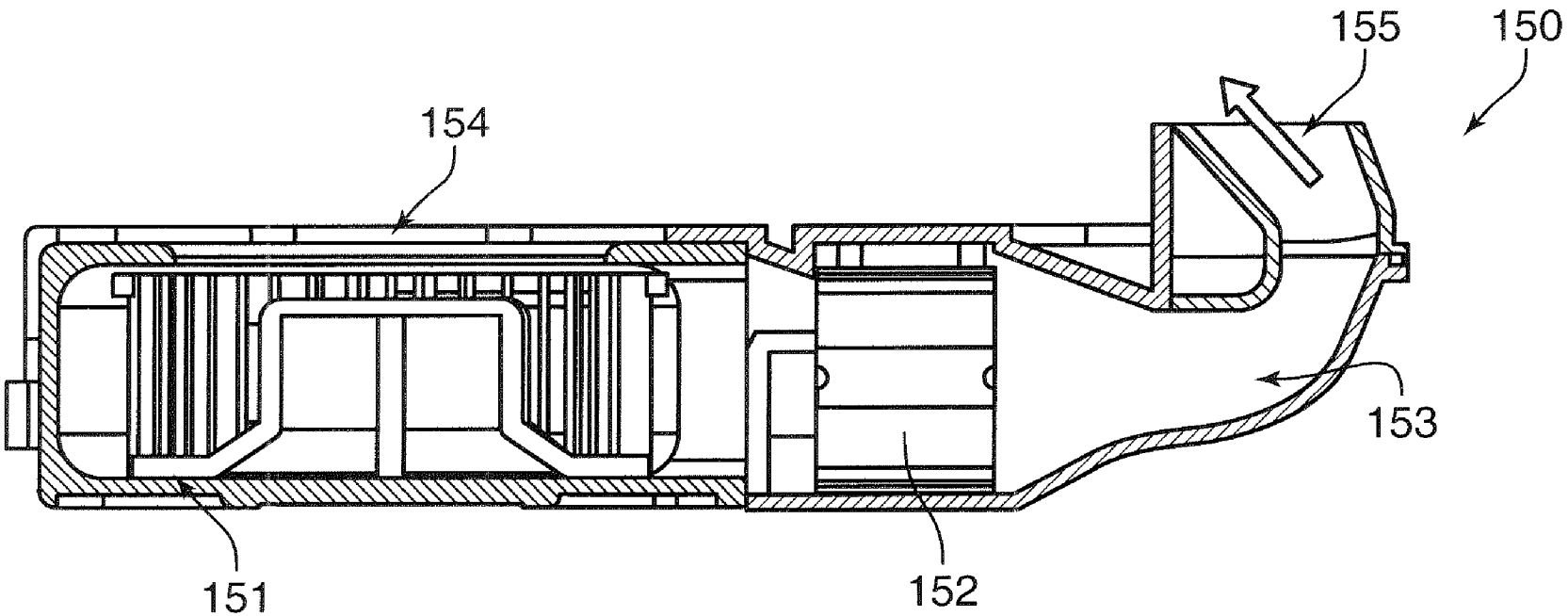
FIG. 7 is a horizontal direction cross-sectional view showing the main parts of a lateral warm air mechanism installed in the sheet feeding device.

The sheet feeding unit 130 according to this embodiment has a lateral warm air mechanism (first warm air mechanism) 150 as a sheet loosening mechanism employing warm air, as shown in FIGS. 2, 3, 6 and 7. The lateral warm air mechanism 150 blows warm air onto a side face of the sheet stack S that is parallel to the sheet feeding direction, the sheet stack S being accommodated in the sheet feeding cassette 130A. FIG. 6 is a perspective view illustrating the configuration of the sheet feeding unit 130. FIG. 7 is a horizontal direction cross-sectional view showing the main parts of the lateral warm air mechanism 150 installed in the sheet feeding unit 130.

The lateral warm air mechanism 150 is provided on the sheet feeding unit main body 130B side. As shown in FIG. 6, a ceiling plate 56 is provided over an upper face of the sheet feeding unit main body 130B such that an upper portion of a sheet accommodating space is sealed by the ceiling plate 56. An opening portion is provided in the ceiling plate 56, and an upper warm air mechanism 140 (second war air unit) described hereinafter is attached to the opening portion.

As shown in FIG. 6, the lateral warm air mechanism 150 is provided along one side face of a sheet feeding cassette 130A in the sheet feeding direction. As shown in FIG. 7, the lateral warm air mechanism 150 includes a first fan 151 and a first heater 152, which are provided in a lateral warm air chamber 153.

As shown in FIG. 7, the lateral warm air mechanism 150 aspirates air from the sheet feeding unit 130 through a first intake port 154 provided in the sheet feeding unit 130. When the first fan 151 is rotated such that the air in the lateral warm air chamber 153 moves to the first heater 152 side, the air in the sheet feeding unit 130 is taken into the lateral warm air chamber 153 through the first intake port 154. The air that moves to the first heater 152 side is heated by the first heater 152 and then blown toward the side face of the sheet stack S through a first warm air blowing port 155.

As shown in FIG. 3, on a vertical cross-section of the sheet conveyance direction, the first warm air blowing port 155 of the lateral warm air mechanism 150 for blowing warm air onto the side face of the sheet stack S in the sheet feeding position is oriented toward a point N at which the pickup roller 40 contacts the upper face of the sheet stack S. Thus, warm air can be applied in a concentrated fashion to the side face of the sheet stack S in exactly the position in which the pickup roller 40 extracts the uppermost sheet, and as a result, warm air can be blown between the sheets in this part efficiently. Hence, the sheet stack S can be loosened efficiently prior to sheet feeding without increasing the size of the lateral warm air mechanism 150.

Figure 8:
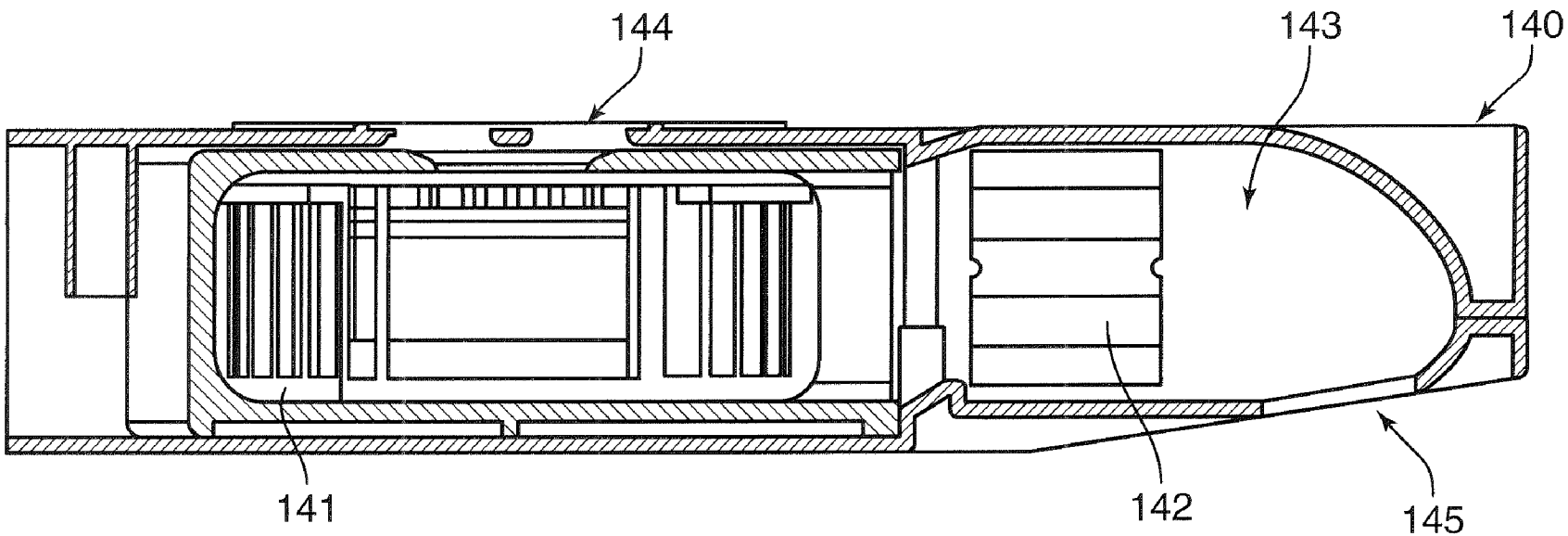
FIG. 8 is a vertical direction cross-sectional view showing the main parts of an upper warm air mechanism installed in the sheet feeding device.

In addition to the lateral warm air mechanism 150, the sheet feeding unit 130 according to the present embodiment also has the upper warm air mechanism 140 as a sheet loosening mechanism employing warm air, as shown in FIGS. 2, 3, 6 and 8. FIG. 8 is a vertical direction sectional view showing the main parts of the upper warm air mechanism 140.

As with the lateral warm air mechanism 150 described above, the upper warm air mechanism 140 is provided on the sheet feeding unit main bogy 130B side. This upper warm air mechanism 140, as shown in FIG. 8, takes in air from a second intake port 144, and blows warm air toward the upper face of the sheet stack S accommodated in the sheet accommodating portion 35 from a second warm air blowing port 145 provided above the upper face of the sheet stack S.

A second fan 141 and a second heater 142 are provided within an upper warm air chamber 143 of the upper warm air mechanism 140. The second intake port 144 is provided in an upper face of the upper warm air chamber 143 above the second fan 141. Specifically, when the second fan 141 rotates, air in the upper warm air chamber 143 moves to the second heater 142 side and outside air is taken into the upper warm air chamber 143 through the second intake port 144. The air that moves to the second heater 142 side is heated by the second heater 142 and blown toward the upper face of the sheet stack S through the second warm air blowing port 145 provided in a lower face of the upper warm air chamber 143. The second warm air blowing port 145 is formed in the upper warm air mechanism 140 on a downstream side of the sheet feeding direction when the upper warm air mechanism 140 is attached to the sheet feeding unit 130.

When a predetermined sheet feeding unit 130 is selected during an image formation operation in the constitution described above, the lift plate 31 is driven to rise, whereby the sheet stack S is raised in the direction of the pickup roller 40, and the upper warm air mechanism 140 is driven to blow warm air toward the upper face of the sheet stack S through the second warm air blowing port 145.

Here, the upper face and peripheral part of the sheet stack S are exposed to outside air and are therefore likely to contain a lot of moisture. In other words, the upper face and side faces of the sheet stack S swell due to moisture absorption, whereas the degree of swelling on the inside of the sheet stack S is lower than that of the upper face and side faces due to the smaller amount of moisture. As a result, a phenomenon occurs whereby pressure on the inside (in the inter-sheet spaces) of the sheet stack S turns negative such that the sheets stick together.

However, according to the sheet feeding unit 130 of this embodiment, the sheet feeding unit 130 has a function of reducing instantaneously a relative humidity of the sheet stack S (the humidity of the upper face and outer peripheral part of the sheet stack S relative to the other parts) as this unit is provided with the upper warm air mechanism 140.

In this embodiment, as will be described hereinafter in detail, elevation drive of the lift plate 31 is controlled in order to realize high-speed continuous sheet feeding while avoiding the occurrence of the problem caused by long-term contact between the upper face of the sheet stack S placed on the lift plate 31 and the pickup roller 40.

Figure 10:
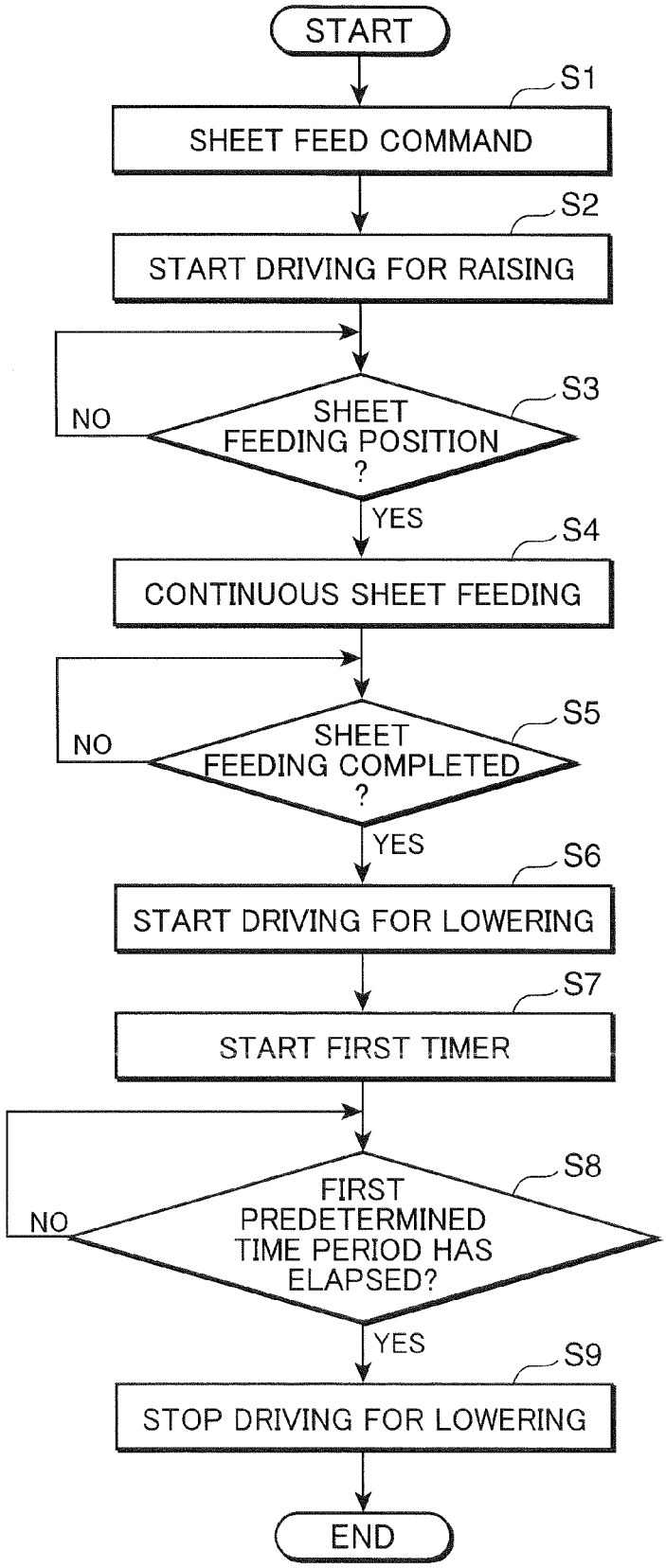
FIG. 10 is a flowchart showing a control procedure performed by the controller.
Figure 11:
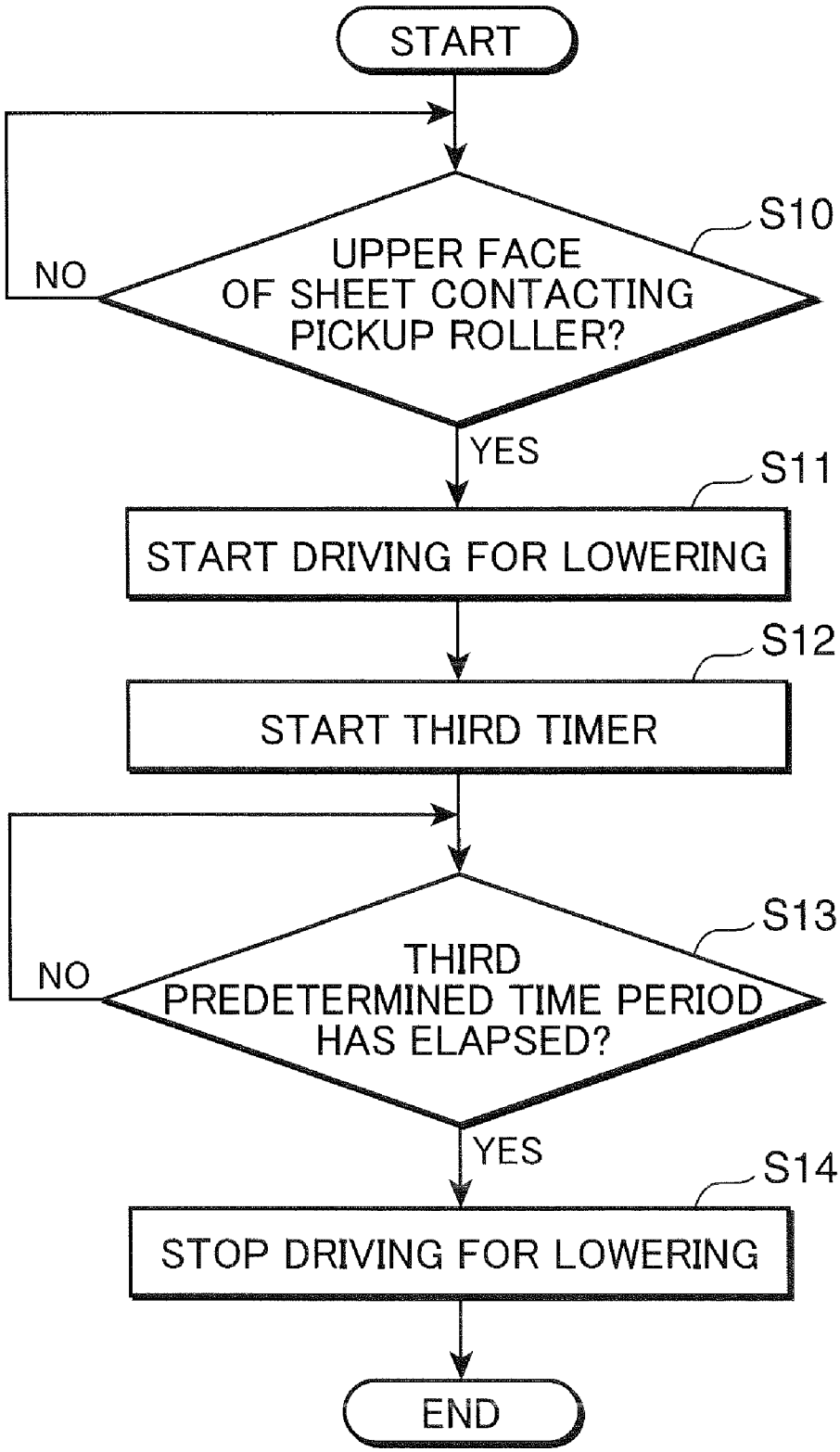
FIG. 11 is a flowchart showing another control procedure performed by the controller.

The step of controlling the elevation drive of the lift plate 31 is described hereinafter with reference to FIGS. 9 to 11. FIG. 9 is a functional block diagram of a controller 300 that controls a warm air blowing operation employing a separating operation. FIGS. 10 and 11 are flowcharts showing an elevation control procedure performed on the lift plate 31 by the controller 300 shown in FIG. 9.

The lift plate 31 of the sheet feeding unit 130 is raised to the sheet feeding position where the upper face of the sheet stack S contacts the pickup roller 40, when the cassette 130A accommodating the sheet stack S is attached to the sheet feeding unit main body 130B. Thereafter, when a sheet feeding command is not issued within a predetermined time period (15 seconds, for example), the lift plate 31 is lowered to the separating position where the upper face of the sheet stack S is separated from the pickup roller 40, and enters a stand-by state.

The controller 300 controls the separating operation for displacing the lift plate 31 between the sheet feeding position and the separating position. The controller 300, which is configured by, for example, a CPU, memories (ROM, RAM and the like), an input interface, and an output interface, functionally has an information input/output part 85, an elevator mechanism controller 80, and a storage unit 84.

Position detection signals from the first position detection sensor PS1 and the second position detection sensor PS2, a sheet type signal from the sheet setting part 39, a first time-up signal from a first timer 86, a second time-up signal from a second timer 87, a third time-up signal from a third timer 88, a temperature sensor signal from a temperature sensor TS, a humidity sensor signal from a humidity sensor HS, and a sheet feeding command signal from a CPU 210 of the printer main body 200 are input to the information input/output part 85.

The elevator mechanism controller 80 includes a lowering drive determination part 82 and a raising drive determination part 83, controls the elevation drive of the elevator mechanism 30 based on each signal input to and output from the information input/output part 85, and performs the separating operation for displacing the lift plate 31 between the sheet feeding position and the separating position by means of the push up member 32.

The lowering drive determination part 82 outputs a control signal for the driving for lowering the lift plate 31 using the push-up member 32 to the lift motor M via the information input/output part 85 on the basis of a first position detection signal from the first position detection sensor PS1, a second position detection signal from the second position detection sensor PS2, the first time-up signal from the first timer 86, the second time-up signal from the second timer 87, the third time-up signal from the third timer 88, the temperature sensor signal from the temperature sensor TS, and the humidity sensor signal from the humidity sensor HS.

The raising drive determination part 83 outputs a control signal for raising the lift plate 31 using the push-up member 32 to the lift motor M via the information input/output part 85 on the basis of the sheet feeding command signal input from the CPU 210 of the printer main body 200.

For example, a first time-up value of the first timer 86, a second time-up value of the second timer 87, a third time-up value of the third timer 88, and an operation program of each controller that correspond to the type of sheets selected by the sheet setting part 39 are stored in the storage unit 84. Further, the storage unit 84 is provided with a storage area for temporarily storing a determination result or other information.

Next, the control procedure performed by the controller 300 of this embodiment is described with reference to FIG. 10. First, when the sheet feeding command signal is input from the CPU 210 of the printer main body 200 to the information input/output part 85 (S1), the raising drive determination part 83 outputs the control signal for the driving for raising the lift plate 31 to the lift motor M via the information input/output part 85. Consequently, raising drive is started on the lift plate 31 (S2).

Next, based on the first position detection signal input from the first position detection sensor PS1 (FIG. 5), the raising drive determination part 83 determines whether or not the lift plate 31 is driven and raised to the sheet feeding position where the upper face of the sheet stack S contacts the pickup roller 40 (S3). When it is determined based on the first position detection signal that the lift plate 31 is raised to the sheet feeding position where the upper face of the sheet stack S contacts the pickup roller 40 (YES in S3), the raising drive determination part 83 halts the activation of the lift motor M and halts the raising drive of the lift plate 31.

At this sheet feeding position, a preset number of sheets are continuously fed (S4). Once the set number of sheets are completely fed (S5), the lowering drive determination part 82 activates the lift motor M and drives and lowers the lift plate 31 to the separating position by means of the push-up member 32 (S6). When the upper face of the sheet stack S is separated from the pickup roller 40 and the first position detection sensor PS1 enters a non-detection state, the first timer 86 starts measurement of time (S7).

Next, based on the first time-up signal input from the first timer 86, the lowering drive determination part 82 determines whether or not a first predetermined time period has elapsed (S8). When it is determined based on the first time-up signal that the first predetermined time period has elapsed (YES in S8), the lowering drive determination part 82 halts the activation of the lift motor M and halts the lowering drive of the lift plate 31 (S9).

Note that when the next sheet feeding command is not issued after completion of sheet feeding (YES in S5), the lowering drive determination part 82 drives and lowers the lift plate 31 to the separating position (S6).

However, when sheet feeding is not started within a predetermined time period (second predetermined time period) after completion of sheet feeding (YES in S5), the elevator mechanism 30 may be controlled such that the lowering drive determination part 82 starts the driving for lowering the lift plate 31. Therefore, when sheet feeding can be started within such a short time period of the second predetermined time period so that the contact between the upper face of the sheet stack S and the pickup roller 40 does not become a problem, it is possible to avoid impairment in the high-speed sheet feeding operation that is caused by unnecessarily driving for lowering the lift plate 31. Note that the predetermined time period (second predetermined time period) may be set appropriately according to the type of sheets. For example, the second predetermined time period may be set to a long time period for regular paper or other type of sheets having low surface smoothness with which the contact thereof with the pickup roller 40 is not a problem.

As shown in FIGS. 2 and 9, the sheet feeding unit 130 has the temperature sensor (temperature detection part) TS for detecting the temperature of the inside of the sheet feeding unit, and the humidity sensor (humidity detection part) HS. Only when the temperature sensor TS detects that the temperature within the sheet feeding unit 130 is at least a predetermined temperature (40° C., for example), or only when the humidity sensor HS detects that the humidity within the sheet feeding unit 130 is at least a predetermined humidity (50%, for example), the lowering drive determination part 82 may control the elevator mechanism 30 to drive and lower the lift plate 31 after completion of the sheet feeding operation.

Because the sheets P swell easily under a high-temperature and/or high-humidity environment, the components contained in the pickup roller 40 adhere to the sheets P, easily causing wrinkles and other problems caused when the upper face of the sheet stack S contacts the pickup roller 40 for a long period of time. Therefore, by controlling the elevator mechanism 30 to drive and lower the lift plate 31 only when such problems are easily caused by the contact between the upper face of the sheet stack S and the pickup roller 40, it is possible to avoid impairment in the high-speed sheet feeding operation that is caused by unnecessarily driving for raising/lowering the lift plate 31.

The lowering drive determination part 82 reads from the storage unit 84 a time period corresponding to the type of sheets selected based on the sheet type signal sent from the sheet setting part 39, as the first predetermined time period. The first predetermined time period is set longer for the sheet P which is of a type that has a high surface smoothness as seen in, for example, gloss art paper or coat paper, and that exhibits a easier swell. According to this configuration, the first predetermined time period can be set to a minimum required lowering time period in order to avoid the contact between the upper face of the sheet P of the selected type with the pickup roller 40. Therefore, time loss by the driving for raising the lift plate to the sheet feeding position for the next sheet feeding can be kept to a minimum.

After the lift plate 31 is lowered to the separating position, the upper face of the sheet P swollen by moisture absorption often contacts the pickup roller 40. Therefore, as shown in the flowchart of FIG. 11, the second position detection sensor (second position detection part) PS2 monitors whether or not the upper face of the sheet P contacts the pickup roller 40, while the lift plate 31 stands by at the separating position (S10). When it is detected that the upper face of the sheet P is in contact with the pickup roller 40 (YES in S10), the lowering drive determination part 82 drives the lift motor M to lower the lift plate 31 further, on the basis of the second position detection signal from the second position detection sensor PS2 (S11). At the same time, the third timer 88 is started (S12).

In this case, based on the third time-up signal from the third timer 88, the lowering drive determination part 82 determines whether or not a third predetermined time period has elapsed (S13). When it is determined based on the third time-up signal that the third predetermined period has elapsed since lowering of the lift plate 31 has started (YES in S13), the lowering drive determination part 82 halts the activation of the lift motor M and halts the lowering drive of the lift plate 31 (S14).

Thus, the sheet P can be reliably controlled and separated from the pickup roller 40, even when the sheet P comes into contact with the pickup roller 40 again due to change in the environment, such as when, for example, the volume of the sheet P expands by absorbing moisture under a high-humidity environment.

Note that the controller 300 according to this embodiment uses the timers to control how much to lower the lift plate 31. However, this embodiment is not limited thereto, and therefore a stepping motor (not shown) for rotating a drive shaft 36 normally and reversely may be adopted to control the amount of lowering the lift plate 31, by the number of drive steps. In this case, the number of drive steps of the stepping motor that is required for the driving for lowering the lift plate 31 using the push-up member 32 and displacing the lift plate 31 from the sheet feeding position to the separating position is stored in the storage unit 84 in accordance with not only the type of a selected sheet, but also the size of the sheet and the print speed. The lowering drive determination part 82 reads the number of drive steps from the storage unit 84 appropriately, in accordance with a selected condition. Then, the controller 300 controls to drive and lower the lift plate 31 so as to rotate the stepping motor by the number of drive steps.

<Industrial Applicability>

The sheet feeding device of the present invention can be applied to image forming apparatuses in general, such as a printer, a copier, a facsimile, or a complex machine having a combination of these functions. Particularly, the sheet feeding device of the present invention can be suitably used when using a sheet having high surface smoothness, such as art paper or coat paper.

Note that the specific embodiment described above mainly includes the invention configured as described above.

A sheet feeding device according to one aspect of the present invention is a sheet feeding device, including: a sheet accommodating portion that accommodates a sheet stack; a sheet carrying plate that is provided within the sheet accommodating portion and stacks the sheet stack thereon; a pickup roller that contacts an upper face of the sheet stack and dispatches a sheet on an uppermost layer of the sheet stack; an elevator mechanism that displaces the sheet carrying plate between a sheet feeding position in which the upper face of the sheet stack contacts the pickup roller, and a separating position in which the upper face of the sheet stack separates from the pickup roller by a predetermined distance; and a controller that controls an operation of the elevator mechanism such that the sheet carrying plate is lowered to the separating position after a sheet feeding operation for feeding a sheet located in the sheet feeding position is completed.

According to the configuration described above, even after completion of the sheet feeding operation, the amount of time during which the upper face of the sheet stack is in contact with the pickup roller can be reduced, in comparison with the conventional configuration in which the lift plate stands by at the sheet feeding position where the upper face of the sheet stack contacts the pickup roller. Therefore, the problems caused when the upper face of the sheet stack contacts the pickup roller for a long period of time can be avoided.

For example, even when using a sheet having high surface smoothness, such as gloss art paper or coat paper, it is possible to reduce the occurrence of the damage on the surface smoothness caused by adhesion of the components contained in the pickup roller, as well as the generation of wrinkles. Further, setting the separating position to an appropriate position having a minimum required space for avoiding the contact between the upper face of the sheet stack and the pickup roller, in accordance with the type of sheets and other conditions, makes a result that the high-speed continuous sheet feeding for feeding the sheets can be maintained, and the problems caused when the upper face of the sheet stack contacts the pickup roller for a long period of time can be avoided.

The configuration described above further desirably has a first position detection part for detecting that the upper face of the sheet stack is in the sheet feeding position, wherein after the elevator mechanism starts the driving for lowering the sheet carrying plate, the controller controls the operation of the elevator mechanism to continue the driving for lowering the sheet carrying plate until a first predetermined time period elapses since when the first position detection part does not detect that the upper face of the sheet stack is in the sheet feeding position.

Even when the sheet feeding operation is ended and the driving for lowering the sheet carrying plate is started, normally a predetermined time period is required until the upper face of the sheet stack no longer contacts the pickup roller. Therefore, by continuing the driving for lowering the sheet carrying plate until the first predetermined time period elapses, it becomes possible to reliably avoid the problems of adhesion of the components of the pickup roller to the sheets and the generation of wrinkles, the problems being caused when the upper face of the sheet stack contacts the pickup roller for a long period of time.

In the configuration described above, it is desired that after the sheet feeding operation for feeding the sheet from the sheet stack at the sheet feeding position is completed, the controller controls the elevator mechanism to start driving for lowering the sheet carrying plate when feeding of a next sheet is not carried out within a second predetermined time period.

According to this configuration, when feeding the next sheet is started within the second predetermined time period, the sheet carrying plate is not driven and lowered. Therefore, by setting the second predetermined time period at a time period during which the occurrence of the problems caused by long-term contact between the upper face of the sheet stack and the pickup roller is not predicted, the high-speed sheet feeding operation can be prevented from being degraded by unnecessarily driving for raising the sheet carrying plate. Note that the second predetermined time period may be set appropriately at a long time period in accordance with the type of sheets, when using regular paper or other type of sheets having low surface smoothness with which the contact thereof with the pickup roller is not a problem.

It is desired that the configuration described above desirably further have: a temperature detection part for detecting a temperature within the sheet feeding device, wherein only when the temperature detection part detects that the temperature within the sheet feeding device is at least a predetermined temperature, the controller controls the drive of the elevator mechanism to lower the sheet carrying plate after completion of the sheet feeding operation.

In addition, it is desired that the configuration described above further have a humidity detection part for detecting a humidity within the sheet feeding device, wherein only when the humidity detection part detects that the humidity within the sheet feeding device is at least a predetermined humidity, the controller controls the drive of the elevator mechanism to lower the sheet carrying plate after completion of the sheet feeding operation.

The sheet swells easily under a high-temperature and/or high-humidity environment. Therefore, the problems of adhesion of the components of the pickup roller to the sheets and the generation of wrinkles, which are caused when the upper face of the sheet stack contacts the pickup roller for a long period of time, occur easily. Therefore, in the configuration described above, only when the temperature detection part detects that the temperature within the sheet feeding device is at least the predetermined temperature, or only when the humidity detection part detects that the humidity within the sheet feeding device is at least the predetermined humidity, the controller controls the elevator mechanism to drive and lower the sheet carrying plate after completion of the sheet feeding operation. Therefore, because the sheet carrying plate is driven and lowered only when the problems easily occur by the contact between the upper face of the sheet stack and the pickup roller, the high-speed sheet feeding operation can be prevented from being degraded by unnecessarily driving for raising the sheet carrying plate.

It is desired that the configuration described above further have a second position detection part for detecting that the upper face of the sheet stack contacts the pickup roller, wherein when the sheet carrying plate is in the separating position and the second position detection part detects that the upper face of the sheet stack contacts the pickup roller, the controller further drives the sheet carrying plate to lower the same until a predetermined third time period elapses since the start of the lowering of the sheet carrying plate.

Even after lowering the sheet carrying plate to the separating position, sometimes the upper face of the sheet swollen due to moisture absorption contacts the pickup roller. Therefore, by further driving for lowering the sheet carrying plate until the third predetermined time elapses since the start of the lowering of the sheet carrying plate, it is possible to reliably avoid the problems of adhesion of the components of the pickup roller to the sheet and the generation of wrinkles, the problems being caused when the upper face of the sheet stack contacts the pickup roller for a long period of time.

It is desired that the configuration described above further include a sheet setting part for setting a type of a sheet to be fed, wherein the controller controls the drive of the elevator mechanism to lower the sheet carrying plate after completion of the sheet feeding operation, only when the type of a sheet set by the sheet setting part is a predetermined type.

According to this configuration, only when selecting a sheet that easily causes the problem caused by long-term contact between the upper face of the sheet stack and the pickup roller for a long period of time, the sheet carrying plate can be driven and lowered after completion of the sheet feeding operation. Therefore, the high-speed sheet feeding operation can be prevented from being degraded by unnecessarily driving for raising the sheet carrying plate.

It is desired that in the configuration described above, the elevator mechanism further include: a push-up member that pushes up the sheet carrying plate, wherein the sheet carrying plate is supported such that a sheet feeding direction upstream-side end thereof freely rotates within the sheet accommodating portion, and the push-up member pushes up the sheet carrying plate due to a configuration in which one end of the push-up member is rotatably supported by a drive shaft and the other end thereof contacts a bottom surface of the sheet carrying plate.

The cantilever elevator mechanism in which one end of the push-up member is supported by the drive shaft is often used in relatively small sheet feeding devices. According to the configuration described above, even when such a cantilever elevator mechanism is provided, the sheets can be fed continuously at high speed without causing stains, wrinkles, and so on.

The configuration described above may include a storage unit for storing a time period of the driving for lowering the elevator mechanism in accordance with the type of a sheet; and a timer for measuring, from when the driving for lowering the elevator mechanism is started, a time period of the driving for lowering the elevator mechanism, wherein the controller controls the elevator mechanism to continue the driving for lowering the sheet carrying plate until the timer measures the time period of the driving for lowering the sheet carrying plate.

In this case, the elevator mechanism may include: the elevator mechanism includes a stepping motor that rotates a drive shaft forwardly and reversely, the number of the steps of the stepping motor for the lower driving according to the type of a sheet is stored in the storage unit, and the controller controls the stepping motor to rotate the stepping motor by the number of the steps for the lower driving according to the type of a sheet, which is read from the storage unit.

The driving for lowering the sheet carrying plate can be realized by each of the configurations described above. According to each of the configurations, because the degree of lowering the sheet carrying plate (separating position) is adjusted in accordance with the type of sheets, the elevator mechanism can be controlled to lower the sheet carrying plate to the position that has a minimum required space for avoiding the contact between the upper face of the sheet stack and the pickup roller, in accordance with the selected type of sheets. Therefore, the high-speed sheet feeding operation can be prevented from being degraded by unnecessarily driving for raising the sheet carrying plate.

The configuration described above may further have a first warm air mechanism for blowing warm air onto a side face of the sheet stack accommodated in the sheet accommodating portion, the side face being parallel to the sheet feeding direction. According to this configuration, warm air can be blown into the sheets, and therefore sheet stack S can be loosened efficiently prior to sheet feeding.

In this case, if the first warm air mechanism blows warm air onto the point where the pickup roller and the upper face of the sheet stack contact with each other, the sheet stack can be loosened more efficiently.

Furthermore, it is desired that the configuration described above has a second warm air mechanism for blowing warm air toward the upper face of the sheet stack accommodated in the sheet accommodating portion. According to this configuration, the degree of humidity absorption on the upper face or peripheral section of the sheet stack can be reduced immediately so that the sheet stack S can be loosened easily.

An image forming apparatus according another aspect of the present invention includes the sheet feeding device having each of the configurations described above, and an image forming portion for forming an image on a sheet fed from the sheet feeding device. According to this configuration, by providing the sheet feeding device having each of the configurations described above, it becomes possible to realize an image forming apparatus capable of continuously feeding sheets at high speed without causing any problems such as stains on the sheet generated when the sheet contacts the pickup roller, generation of wrinkles, and so on.

The present invention described above can provide a sheet feeding device capable of high-speed continuous sheet feeding without causing the occurrence of stains, wrinkles and so on the sheets that are generated when the pickup roller contacts the sheets, and can also provide an image forming apparatus having this sheet feeding device.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A sheet feeding device, comprising:

a sheet feeding cassette including a sheet accommodating portion that accommodates a sheet stack;

a main body portion to which the sheet feeding cassette is attached;

a sheet carrying plate that is provided within the sheet accommodating portion and stacks the sheet stack thereon;

a pickup roller that has a cylindrical periphery disposed for contacting an upper face of the sheet stack and for dispatching a sheet on an uppermost layer of the sheet stack;

an elevator mechanism that displaces the sheet carrying plate between a sheet feeding position in which the upper face of the sheet stack contacts the pickup roller, and a separating position in which the upper face of the sheet stack separates from the pickup roller by a predetermined distance; and a controller that controls an operation of the elevator mechanism while the sheet feeding cassette remains attached to the main body portion such that the sheet carrying plate is lowered from the sheet feeding position to the separating position after passage of a first predetermined time between completion of a preceding sheet feeding operation for feeding a sheet located in the sheet feeding position and initiation of a subsequent sheet feeding operation, thereby preventing contact between the pickup roller and the sheet on the uppermost layer of the sheet stack for time periods in excess of the first predetermined time, wherein the controller, in controlling the operation of the elevator mechanism, causes a lowering of the sheet carrying plate from the sheet feeding position for a second predetermined time period sufficient for the sheet carrying plate to reach the separating position so that the upper face of the sheet stack is separated from the pickup roller by the predetermined distance.

2. The sheet feeding device according to claim 1, further comprising:

a first position detection part for detecting that the upper face of the sheet stack is in the sheet feeding position, wherein after the elevator mechanism starts the driving for lowering the sheet carrying plate, the controller controls the operation of the elevator mechanism to continue the driving for lowering the sheet carrying plate until the second predetermined time period elapses since when the first position detection part does not detect that the upper face of the sheet stack is in the sheet feeding position.

3. The sheet feeding device according to claim 1, further comprising:

a second warm air mechanism for blowing heated air toward the upper face of the sheet stack accommodated in the sheet accommodating portion.

4. The sheet feeding device according to claim 1, further comprising:

a temperature detection part for detecting a temperature within the sheet feeding device, wherein only when the temperature detection part detects that the temperature within the sheet feeding device is at least a predetermined temperature, the controller controls the drive of the elevator mechanism to lower the sheet carrying plate after completion of the sheet feeding operation.

5. The sheet feeding device according to claim 1, further comprising:

a humidity detection part for detecting a humidity within the sheet feeding device, wherein only when the humidity detection part detects that the humidity within the sheet feeding device is at least a predetermined humidity, the controller controls the drive of the elevator mechanism to lower the sheet carrying plate after completion of the sheet feeding operation.

6. The sheet feeding device according to claim 1, further comprising:

a second position detection part for detecting that the upper face of the sheet stack contacts the pickup roller, wherein when the sheet carrying plate is in the separating position and the second position detection part detects that the upper face of the sheet stack contacts the pickup roller, the controller further drives the sheet carrying plate to lower the same until a predetermined third time period elapses since the start of the lowering of the sheet carrying plate.

7. The sheet feeding device according to claim 1, further comprising:

a sheet setting part for setting a type of a sheet to be fed, wherein the controller controls the drive of the elevator mechanism to lower the sheet carrying plate after completion of the sheet feeding operation, only when the type of a sheet set by the sheet setting part is a predetermined type.

8. The sheet feeding device according to claim 1, further comprising:

a push-up member that pushes up the sheet carrying plate, wherein the sheet carrying plate is supported such that a sheet feeding direction upstream-side end thereof freely rotates within the sheet accommodating portion, and the push-up member pushes up the sheet carrying plate due to a configuration in which one end of the push-up member is rotatably supported by a drive shaft and the other end thereof contacts a bottom surface of the sheet carrying plate.

9. The sheet feeding device according to claim 1, further comprising:

a storage unit for storing the second predetermined time period of the driving for lowering the elevator mechanism in accordance with the type of a sheet; and a timer for measuring, from when the driving for lowering the elevator mechanism is started, the second predetermined time period of the driving for lowering the elevator mechanism, wherein the controller controls the elevator mechanism to continue the driving for lowering the sheet carrying plate until the timer measures the second predetermined time period of the driving for lowering the sheet carrying plate.

10. The sheet feeding device according to claim 9, wherein the elevator mechanism includes a stepping motor that drives the elevator mechanism downward, the number of driving steps of the stepping motor for the lower driving according to the type of a sheet and required to drive the elevator mechanism downward is stored in the storage unit, and the controller controls the stepping motor to read the number of the driving steps of the stepping motor from the storage unit according to the type of a sheet, and to rotate the stepping motor by the number of the driving steps.

11. The sheet feeding device according to claim 1, further comprising:

a first warm air mechanism for blowing heated air onto a side face of the sheet stack accommodated in the sheet accommodating portion, the side face being parallel to the sheet feeding direction.

12. The sheet feeding device according to claim 11, wherein the first warm air mechanism blows heated air onto a point where the pickup roller and the upper face of the sheet stack contact with each other.

13. A sheet feeding device, comprising:

a sheet accommodating portion that accommodates a sheet stack;

a sheet carrying plate that is provided within the sheet accommodating portion and stacks the sheet stack thereon;

a pickup roller that has a cylindrical periphery contacting an upper face of the sheet stack and dispatches a sheet on an uppermost layer of the sheet stack;

an elevator mechanism that displaces the sheet carrying plate between a sheet feeding position in which the upper face of the sheet stack contacts the pickup roller, and a separating position in which the upper face of the sheet stack separates from the pickup roller by a predetermined distance;

a first heated air mechanism for blowing heated air onto a side face of the sheet stack accommodated in the sheet accommodating portion, the side face being parallel to the sheet feeding direction, the first heated air mechanism blowing the heated air toward a position at which the pickup roller contacts the upper face of the sheet stack; and a controller that controls an operation of the elevator mechanism such that the sheet carrying plate is lowered to the separating position after a sheet feeding operation for feeding a sheet located in the sheet feeding position is completed.

14. An image forming apparatus, comprising:

a sheet feeding device for feeding a sheet; and an image forming portion for forming an image onto the sheet fed from the sheet feeding device, wherein the sheet feeding device includes:

a sheet feeding cassette including a sheet accommodating portion for accommodating a sheet stack of a plurality of sheets;

a main body portion to which the sheet feeding cassette is attached;

a sheet carrying plate that is provided within the sheet accommodating portion and stacks the sheet stack thereon;

a pickup roller that has a cylindrical periphery disposed for contacting an upper face of the sheet stack and for dispatching a sheet on an uppermost layer of the sheet stack;

an elevator mechanism that displaces the sheet carrying plate between a sheet feeding position in which the upper face of the sheet stack contacts the pickup roller, and a separating position in which the upper face of the sheet stack separates from the pickup roller by a predetermined distance; and a controller that controls an operation of the elevator mechanism while the sheet feeding cassette remains attached to the main body portion such that the sheet carrying plate is lowered from the sheet feeding position to the separating position after passage of a first predetermined time between completion of a preceding sheet feeding operation for feeding a sheet at the sheet feeding position and initiation of a subsequent sheet feeding operation, thereby preventing contact between the pickup roller and the sheet on the uppermost layer of the sheet stack for time periods in excess of the first predetermined time, wherein the controller, in controlling the operation of the elevator mechanism to cause a lowering of the sheet carrying plate from the sheet feeding position for a second predetermined time sufficient for the sheet carrying plate to reach the separating position so that the upper face of the sheet stack is separated from the pickup roller by the predetermined distance.

* * * * *